United States Patent [19]

Rozga

[11] 4,130,275

[45] Dec. 19, 1978

[54] SKEW CONTROL MECHANISM FOR SHEET MATERIAL

[75] Inventor: Vincent E. Rozga, Greendale, Wis.

[73] Assignee: Kelley Company Inc., Milwaukee, Wis.

[21] Appl. No.: 762,476

[22] Filed: Jan. 26, 1977

[51] Int. Cl.[2] ..... B65H 9/16

[52] U.S. Cl. ..... 271/251

[58] Field of Search ..... 271/251, 253, 254, 255, 271/252, 226, 268, 277

[56] References Cited

U.S. PATENT DOCUMENTS

| | | | |
|---|---|---|---|
| 2,464,173 | 3/1949 | Broadmeyer | 271/251 |
| 2,638,343 | 5/1953 | Luehrs | 271/251 X |
| 3,750,924 | 8/1973 | Pepper | 226/180 X |

*Primary Examiner*—Richard A. Schacher

*Attorney, Agent, or Firm*—Andrus, Sceales, Starke & Sawall

[57] ABSTRACT

A skew control mechanism for sheet material. Sheet material, such as corrugated paperboard, is slit into strips of various widths and the slit strips are then cut transversely into lengths by a cut-off machine. The cut sections are conveyed by an endless belt conveyor to a stacking mechanism, and to prevent skewing of the cut sections on the conveyor, a skew control mechanism is mounted for movement on the frame of the machine. The skew control mechanism includes a series of carriages located along each side of the machine and the carriages at each side are connected together by links, while transverse shafts are pivoted to carriages at opposite sides of the machine. A plurality of wheels are mounted for floating vertical movement about each shaft and the wheels ride on the upper surfaces of the cut sections. An adjusting mechanism is incorporated which enables the shafts to be pivoted with respect to the carriages so that the axes of the wheels can be adjusted with respect to the machine direction and thereby steer the cut sections into proper machine direction alignment.

4 Claims, 7 Drawing Figures

SKEW CONTROL MECHANISM FOR SHEET MATERIAL

BACKGROUND OF THE INVENTION

In the manufacture of corrugated paperboard, paper sheets are bonded with an adhesive to opposite faces of a corrugated core, and the laminated sheet is then passed through a slitter which slits the sheets into a series of strips of various predetermined widths. The slit strips are then passed through cut-off knives which cut the slit strip into lengths. As it is often desired to cut the strips into different lengths, multiple cut-off units are used, with certain of the strips being directed to one cut-off knife, and other groups of strips being directed to a second cut-off knife.

Following the cutting of the strips, the cut lengths or sections are conveyed to a stacking mechanism, as described in U.S. Pat. No. 3,905,595, which serves to stack the cut sections and convey the stacks to a given site.

It is important that the cut sections be maintained in proper machine direction orientation on the conveyor approaching the stacking machine, for if the cut sections are skewed, interleaving of the sections will occur during the stacking with the result that the stacks cannot be properly separated from one another.

Attempts have been made in the past to prevent skewing or misalignment of the cut sections on the conveyor leading to the stacking machine. In the past, canvas drapes have been employed which were adapted to ride on the cut sections in an attempt to prevent skewing. However, the draped canvas would not correct skewing which may have occurred at the cut-off knife and would, at most, control skewing on the conveyor. Furthermore, the use of the draped canvas had certain distinct disadvantages in that after a period of use the canvas became ragged or worn, and the draped canvas also restricted access to the conveyor in the event of a jam-up.

Attempts have also been made in the past to control skewing of the cut sections on the conveyor by use of sandwich belts in which the cut sections were held between the cooperating endless belts. The use of the cooperating belts, at most, controlled skewing on the conveyor and did not correct skewing which had occurred at the cut-off knives. Furthermore, the gap or spacing between the cooperating belts was set for a given thickness of paperboard, and during normal daily operation, it was common for various thicknesses of paperboard to be run through the machine. With the gap set for the thickest paperboard, the unit would not give proper control when running paperboard of lesser thickness.

Pivoted floation rolls have also been used in the past in an attempt to control skewing on the conveyors. In this type of system, one or more transverse rolls were mounted to ride against the upper surfaces of the cut sections and the resulting pressure would provide some measure of control against skewing. However, the use of the pivoted flotation rolls would not correct skewing which had occurred at the cut-off knife. Moreover, if the cut sections were located only along one side edge of the conveyor, the flotation roll would tend to tilt, with the result that a differential in pressure would be applied transversely across the cut sections, causing the sections to skew, so that under certain conditions, the flotation rolls accentuated, rather than controlled skewing.

SUMMARY OF THE INVENTION

The invention relates to a skew control mechanism to prevent skewing of cut pieces or sections of sheet material as they exit from the cut-off machine. In accordance with the invention, the skew control mechanism includes a supporting structure or frame having carriages which are mounted for movement on guideways on the cut-off machine so that the mechanism can be installed or removed from the cut-off machine as an integral unit. The carriages along each side of the frame are pivotally connected together by longitudinal arms, while shafts extend transversely of the frame and are pivoted to carriages at opposite sides of the frame.

Pivotally mounted on each shaft is a group of individual wheels which are adapted to ride on the cut sections of sheet material being conveyed by the endless belt conveyor. The wheels provide segmented floation and act to apply substantially uniform pressure to all of the cut sections regardless of their position on the conveyor. The use of the individual wheels will not accentuate skewing as can occur with the use of a single transverse floating roll, as used in the past.

An adjustment feature is incorporated with the skew control mechanism which enables skewed sections to be steered or directed back into machine direction alignment. To provide this adjustment, adjusting studs are connected to the carriages at each side of the frame and by adjustment of the studs, the shafts and wheels can be shifted relative to the machine direction. By proper shifting of the axis of the wheels, the cut sections can be steered back into machine direction orientation to thereby compensate for any skewing produced by the cut-off knives.

As a further advantage, the entire skew control mechanism can be readily removed from the machine for purposes of servicing the cut-off knives or for removing any jam-ups that may have occurred.

The skew control mechanism incorporates a sufficient number of transverse shafts which carry the flotation wheels to insure that even the shortest lengths of cut sections are always in flotation control. It is preferred to have at least two wheels in contact with each cut section at all times.

The flotation wheels are equipped with low pressure pneumatic tires which provide a shock absorbing action.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figures 1, 7:
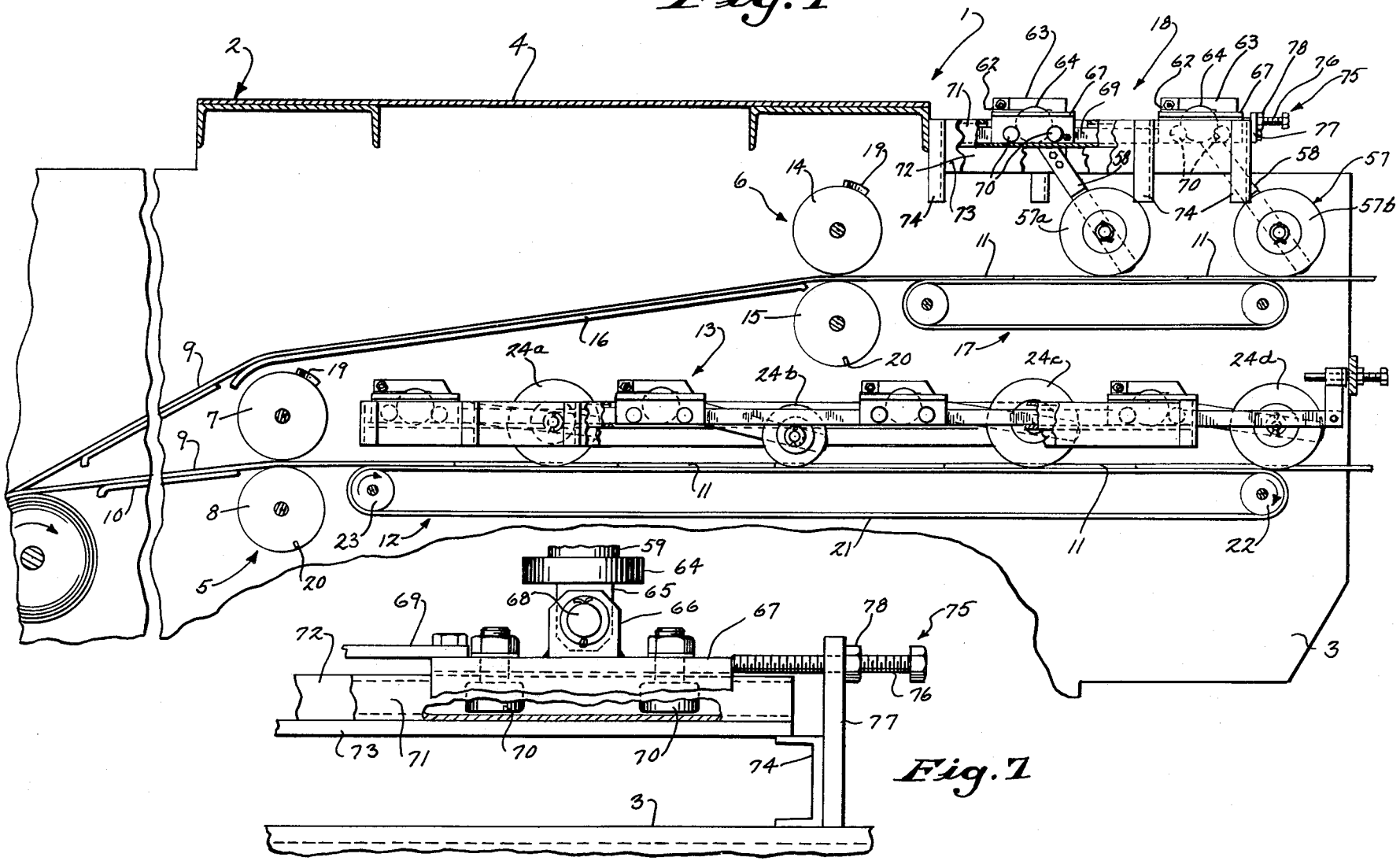
FIG. 1 is a side elevation with parts broken away showing the skew control mechanism of the invention as incorporated with the cut-off machine.
FIG. 7 is an enlarged fragmentary side elevation with parts broken away showing the adjusting mechanism for the carriage.

FIG. 1 illustrates a cut-off machine 1 for cutting previously slit strips of corrugated paperboard into lengths. The cut-off machine includes a housing 2 having a pair of side walls 3 and a top wall 4 which is connected between the central portions of the side walls 3. A lower cut-off unit 5 and an upper cut-off unit 6 are located within the housing 2, and each cut-off unit serves to cut one or more of the slit strips transversely into lengths or sections. The use of the two cut-off units 5 and 6 enables the strips to be selectively cut to two different lengths, as opposed to a machine incorporating a single cut-off unit in which all of the slit strips would be cut to the same length.

The lower cut-off unit 5 is of conventional construction and includes a pair of cooperating cut-off rolls 7 and 8. The slit strips 9 are fed to the cut-off rolls 7 and 8 on a feed plate 10, and the cut sections or lengths 11 are conveyed by a conveyor unit 12 to an automatic stacking machine, not shown, but which can be of the type described in U.S. Pat. No. 3,905,595. In accordance with the invention a skew control mechanism indicated generally by 13, is associated with the conveyor unit 12 to prevent skewing of the cut sections 11 on the conveyor and to steer any previously skewed sections into machine direction alignment.

The upper cut-off unit 6 is similar to the lower cut-off unit 5 and includes a pair of cooperating cut-off rolls 14 and 15. The slit strips 9 are fed to the cut-off rolls 14 and 15 on a feed plate 16, and the cut sections 11 are conveyed on the conveyors unit 17 to the stacking machine. A skew control mechanism 18, similar to skew control mechanism 13, is associated with the upper conveyor unit 17.

The cut-off rolls 7, 8, 14 and 15 are of conventional contruction, and the upper rolls 7 and 14 each include one or more generally helical or spiral blades 19 which cooperate with a spiral groove 20 in the lower rolls 8 and 15 to cut the strips 9 as they pass between the rolls.

The conveyor unit 12 includes an endless conveyor belt 21 which travels over a drive roll 22 and idler roll 23. The drive roll 22 can be driven by any conventional drive mechanism to thereby move the belt 21 in its endless conveying path.

The skew control mechanism 13 includes a series of groups of wheels 24 which ride on the cut section 11 being conveyed on belt 21, and the wheels of each group are spaced transversely across the machine. As shown in FIG. 1, there are four groups of wheels *24a–24d*, but the number of groups and the spacing between groups can vary depending on the length of the cut sections 11. The longitudinal spacing between adjacent groups of wheels is designed so that the wheels of at least one group will be in contact with each of the cut sections 11 at all times to thereby provide proper control for the cut lengths or sections 11.

While the drawings show 10 wheels in each group, the number can vary depending on the width of the machine and the width of the cut strips 9.

Each of the wheels 24 includes a pneumatic tire 25 which is mounted on a hub 26 that is journalled on axle 27. The pressure within the tires is generally maintained at a relative low value in the range of 2 to 5 psig, so that the tires riding on the cut sections 11 will provide a soft cushioning action.

Figure 3:
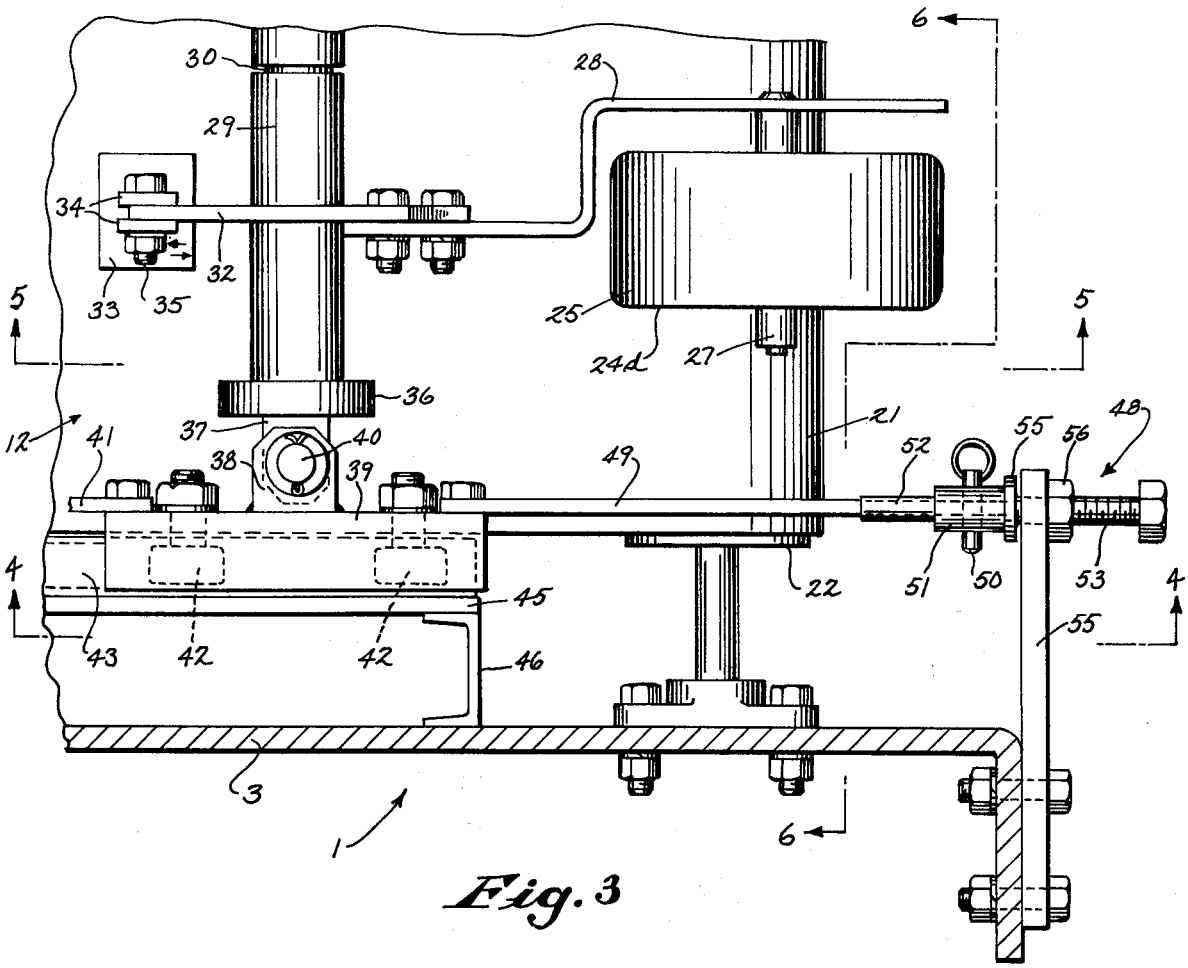
FIG. 3 is an enlarged fragmentary plan view showing the attachment of the wheels to the transverse shaft.

As best illustrated in FIG. 3, each axle 27 is cantileverd from an arm 28 that is secured to a sleeve 29, and sleeves 29 are mounted for rotation on a transverse shaft 30 which extends across the machine. With this construction, the wheels 24 are free to pivot or float in a vertical plane and, thereby apply constant downward pressure on the cut sections 11 which are moving along the conveyor belt 21.

Figure 5:
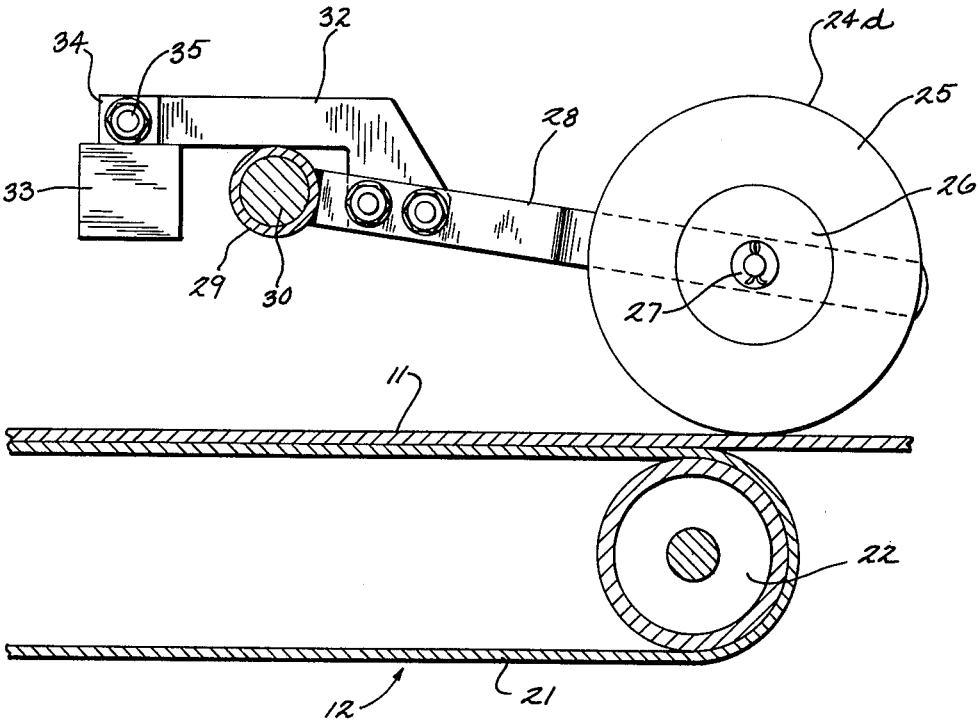
FIG. 5 is a section taken along line 5—5 of FIG. 3.

It is preferred to partially counterbalance the wheels to reduce the downward pressure being applied to the cut sections 11. In this regard, an arm 32 is connected to each of the arms 28 and extends forwardly to the opposite side of the shaft 30 from the arm 28. A counterweight 33 is adjustably connected to the forward end of each arm 32. As shown in FIGS. 3 and 5, the counterweight 33 is provided with a pair of upwardly extending lugs 34 which are connected to the forward end of the arm 32 by a bolt 35. Each bolt extends through a slot in the end of the arm 32, and the slotted connection provides a means of adjusting the position of the counterweight in the machine direction to thereby vary the magnitude of the counterbalance force. As previously noted, the wheels 24, and the pivotal connection of the wheels 24 to shaft 30, along with the counterweight 33 provides a soft floating action which will control the cut lengths and prevent skewing as they move along the conveyor, without adversely loading the conveyor drive mechanism.

Figure 6:
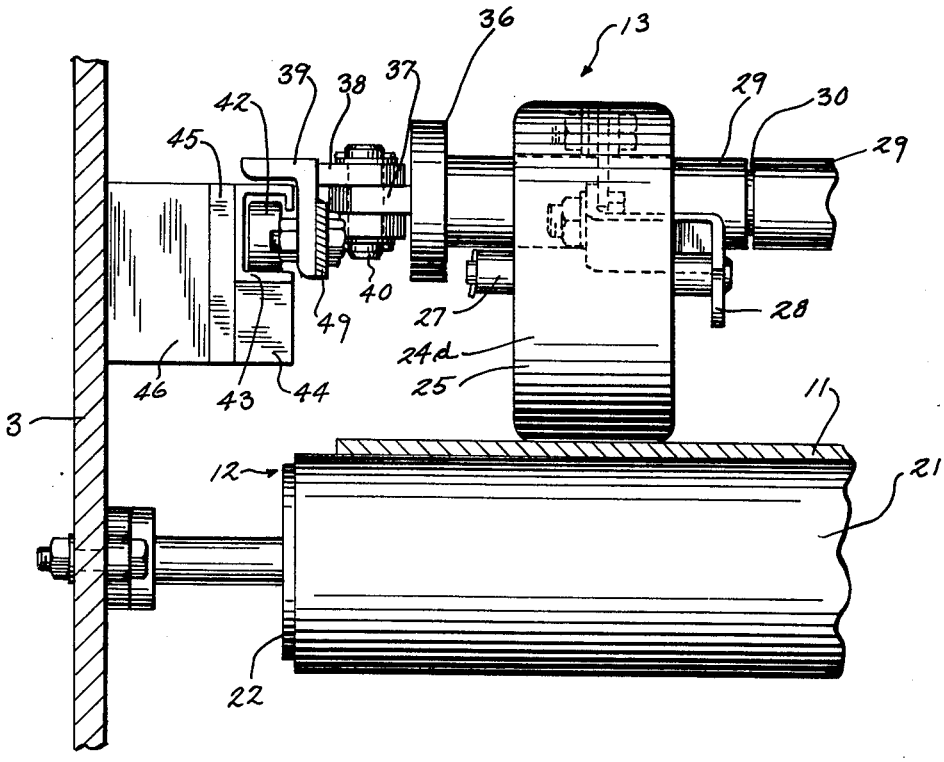
FIG. 6 is a section taken along line 6—6 of FIG. 3.

As illustrated in FIG. 6, the ends of each shaft 30 are provided with collars 36 and lugs 37 extend outwardly from the collars. The lug at each end of the shaft is pivotally connected to clevis 38 on carriage 39 by pin 40. The pins 40 extend through elongated slots in the lugs 37. The carriages 39 located along each side of the machine are pivotally connected together by longitudinal arms 41. The carriages 39, connecting arms 41, shafts 30 and wheels 24 thus comprise an integral unit or structure. To facilitate installation of the skew control mechanism 13 on the machine 1, each carriage 39 is provided with a pair of rollers 42 that are adapted to ride on tracks 43 secured to the side walls 3 of the machine and as shown in FIG. 6, each track 43 is mounted on a bar 44 which is connected to vertical plate 45 that is mounted through channels 46 to the respective side wall 3 of the machine.

With this construction the entire skew control mechanism 13 can be removed as a unit from the cut-off machine by merely sliding the carriages 39 outwardly along the track 43. This greatly facilitates the servicing of the cut-off knives, as well as removing jam-ups of the cut sections that may have occurred at the cut-off knives.

Figure 4:
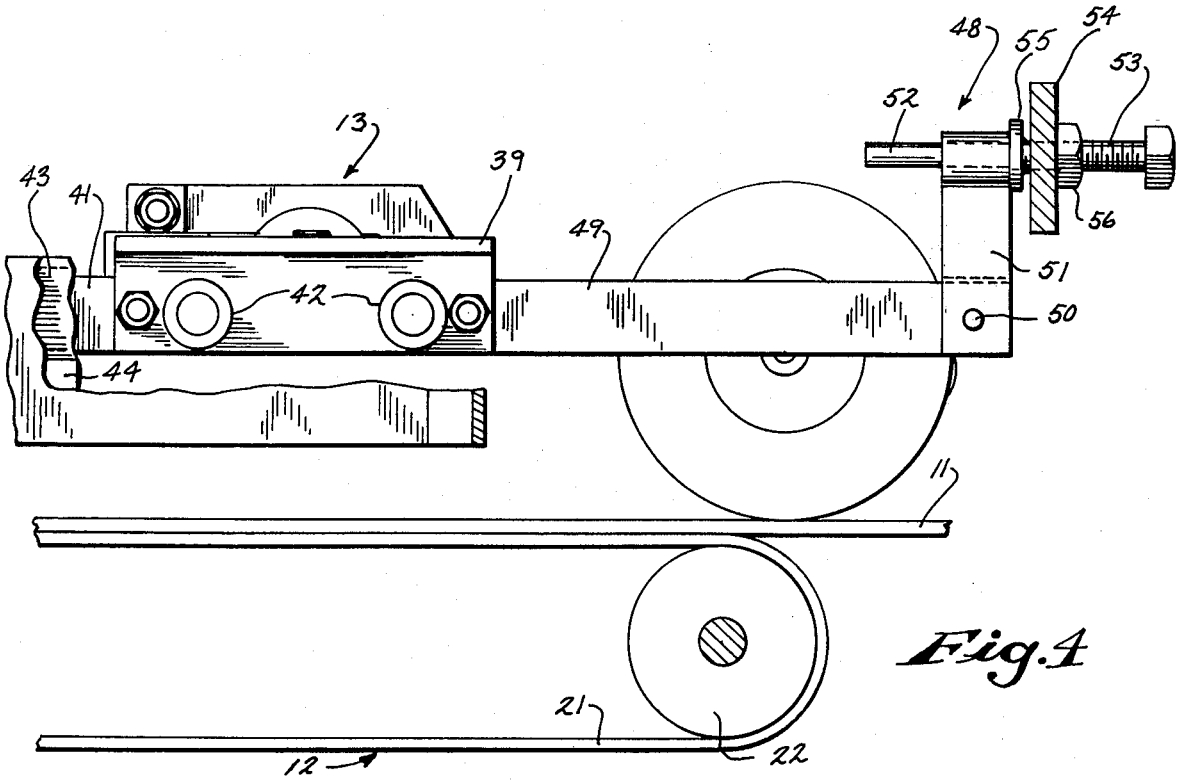
FIG. 4 is a section taken along line 4—4 of FIG. 3.

In accordance with a feature of the invention, an adjusting unit, indicated generally by 48, as best shown in FIGS. 3 and 4, is associated with each side of the skew control mechanism 3 to shift the angularity of the shafts 30 with respect to the machine direction to thereby correspondingly shift the axes of wheels 24 and steer skewed sections 11 into machine direction orientation. Each adjusting unit 48 comprises a horizontal bar 49 which is secured to the rearmost carriage 39. The rear end of the bar 49 is connected by pin 50 to the lower end of a vertical bar 51, and a bolt 52 has an outer threaded end 53, which is threaded within an opening in bracket 54, and has an inner end which extends freely through an opening in the upper end of vertical bar 51. Mounted centrally on bolt 52 is a stop collar 55. As bolt 52 is turned clockwise, stop collar 55 moves vertical bar 51, arm 49 and the corresponding carriages in a direction toward the cut-off knife. Lock nut 56 serves to retain the bolt 52 in position.

The carriages 39 along each side of the machine will be forced rearwardly against the respective adjusting bolt 52 by the force of the cut sections 11 passing through the machine. By threading the bolt 52 at one side of the machine inwardly, the carriages along that side of the machine will be moved forwardly relative to the carriages on the opposite side of the machine to thereby pivot the shafts 30 relative to the machine direction. Pivoting or shifting of the shaft will cause the axes of the wheels 24 to correspondingly shift. In operation, if the operator observes that the cut sections 11 are being discharged from the cut-off knives in a skewed manner, the operator, through adjustment of the bolts 52, can steer the cut sections 11 back into machine direction alignment. On the other hand, if the cut lengths 11 are being discharged from the cut-off knives with the proper machine direction orientation, no adjustment is necessary and the wheels 24 will provide pressurized floatation on the cut sections to prevent skewing as the sections move along the conveyor.

Figure 2:
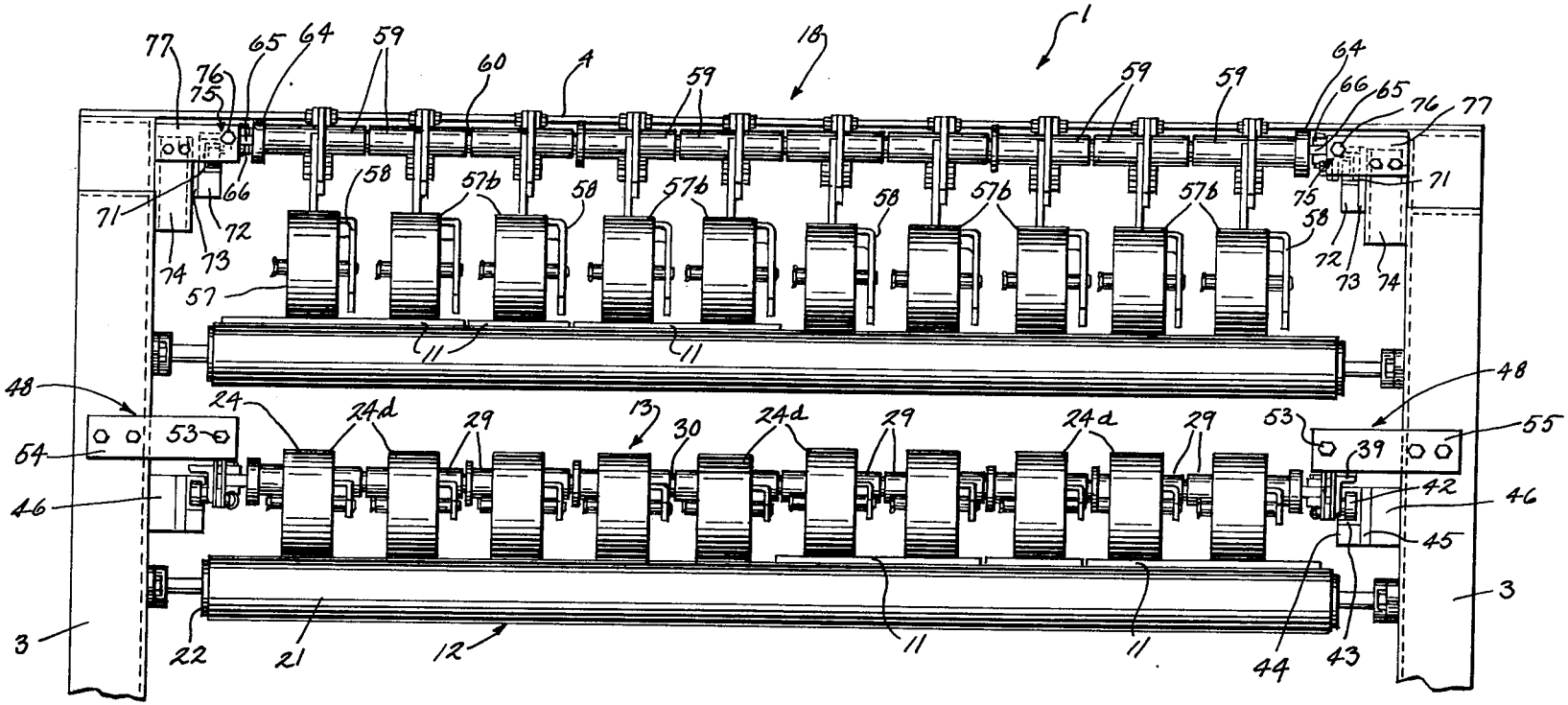
FIG. 2 is an end view of the structure shown in FIG. 1

The skew control mechanism 18 associated with the upper cut-off unit 6 is similar in construction and function to skew control mechanism 13 and comprises a series of groups of wheels 57. As shown in FIG. 1, the conveyor 17, which is similar in construction and function to conveyor 12, has a shorter length than conveyor 12, so that only two groups of wheels 57*a* and 57*b* are utilized. As shown in FIG. 2, the wheels 57 of each group are spaced transversely across the machine.

Each of the wheels 57 is similar in construction to wheels 24 and is supported from an arm 58 that is secured to a sleeve 59 journalled on transverse shaft 60. Spacers 61 are located between the sleeves.

As in the case of the skew control mechanism 13, the weight of the wheels 57 is partially counterbalanced by a counterweight 62 which is adjustably mounted on the end of an arm 62 which extends forwardly from the corresponding arm 58.

The ends of the shafts 60 carry collars 64, and a slotted lug 65 which is secured to each collar is pivotally connected to clevis 66 on carriage 67 by pin 68. As in the case of the lower skew mechanism control- 13, the carriages 67 along each side of the machine are pivotally connected together by connecting arms 69.

Each carriage 67 includes a pair of rollers 70 that ride on track 71 which is supported on bar 72. Each bar 72 is connected through vertical plate 73 and channel 74 to the side wall 3 of the machine.

As in the case of the lower skew control mechanism 13, an adjusting mechanism 75 is associated with each side of the upper skew control mechanism 18 to pivot or shift the shafts 60 relative to the machine direction to thereby steer skewed cut sections 11 back into a machine direction orientation. Each adjusting mechanism 75 includes a bolt 76 which is threaded within an opening in a bracket 77 secured to the rearmost channel 74. The forward end of each bolt engages the rear end of the rearmost carriage 67 and the bolts can be locked in position through lock nuts 78.

The pressure of the cut sections 11 moving along the conveyor 17 forces the carriages at each side of the machine into engagement with the respective bolts 76. By threaded adjustment of the bolts 76, the shafts 60 can be pivoted relative to the carriages 67 to thereby move the axes of the wheels 57 relative to the machine direction. As previously described, if it is observed that the cut sections 11 are skewed as they are discharged from the cut-off knive, the axes of the wheels can be shifted relative to the machine direction by adjustment of bolts 76 to steer the cut sections toward the machine direction.

The apparatus of the invention not only prevents skewing of the cut sections on the conveyor leading to the stacking machine, but is also capable of correcting a skewed condition by steering the skewed sections into machine direction orientation.

Through the use of individual wheels attached to each transverse shaft, segmental floatation is achieved as opposed to entire width flotation as used in prior art machines. The segmental floatation insures that substantially uniform pressure is applied to the cut sections 11 and prevents skewing in the event that the cut sections are located only along one side of the machine.

As the entire skew control mechanism can be readily removed from the machine, servicing of the cut-off knives is facilitated and jam ups can be readily corrected.

The groups of wheels are preferably arranged so that wheels of at least one group are in contact with each cut section at all times, thereby insuring that even the shortest cut section is fully controlled to prevent skewing.

Various modes of carrying out the invention are contemplated as being within the scope of the following claims particularly pointing out and distinctly claiming the subject matter which is regarded as the invention.

I claim:

1. A skew control mechanism for controlling skewing of cut sections of sheet material, comprising a supporting structure, conveyor means carried by the supporting structure for conveying said cut sections in a downstream direction, a pair of tracks located at opposite sides of the conveyor, and a skew control unit mounted above the conveyor, said skew control unit including a frame mounted for movement on said tracks, locking means for locking the frame against movement on said tracks in said downstream direction, said skew control unit including pressure means disposed to engage the upper surfaces of the cut sections moving on the conveyor and mounted for floating movement in a vertical plane, said skew control unit being removable from said tracks on release of said locking means.

2. The mechanism of claim 1, wherein said frame includes a pair of carriages, each carriage disposed to ride on one of said tracks, and said frame includes a transverse shaft interconnecting said carriages, said pressure means being mounted for floating movement on said shaft.

3. The mechanism of claim 2, wherein said pressure means comprises a plurality of pneumatic tired wheels disposed in spaced transverse relation on said shaft.

4. A skew control mechanism for controlling skewing of cut sections of sheet material, comprising a supporting structure, a conveyor carried by the supporting structure for conveying the cut sections in a given direction, a shaft disposed above the conveyor and extending transversely to said direction, a plurality of wheels mounted in spaced transverse relation above the conveyor and disposed to engage the upper surfaces of the cut sections, mounting means for mounting each wheel on said shaft for individual floating movement in a vertical plane, a carriage pivotally connected to each end of the shaft, a track mounted on each side of the supporting structure, said carriages being mounted for movement on the respective tracks, a stop on each track and disposed to be engaged by the respective carriage to limit the movement of the carriage in said direction, and means to individually adjust the position of each stop, whereby movement of one stop relative to the other stop will shift the axis of the shaft to thereby shift the axes of said wheels with respect to said direction to steer the skewed sections toward said direction.

* * * * *